US009347138B2

(12) United States Patent
Blue et al.

(10) Patent No.: US 9,347,138 B2
(45) Date of Patent: May 24, 2016

(54) IN-SITU COMPOSITE FORMATION OF DAMAGE TOLERANT COATINGS UTILIZING LASER

(71) Applicant: UT-BATTELLE, LLC, Oak Ridge, TN (US)

(72) Inventors: Craig A. Blue, Knoxville, TN (US); Frank Wong, Livermore, CA (US); Louis F. Aprigliano, Berlin, MD (US); Peter G. Engleman, Knoxville, TN (US); William H. Peter, Knoxville, TN (US); Tibor G. Rozgonyi, Golden, CO (US); Levent Ozdemir, Golden, CO (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 15 days.

(21) Appl. No.: 14/157,012

(22) Filed: Jan. 16, 2014

(65) Prior Publication Data

US 2014/0134451 A1 May 15, 2014

Related U.S. Application Data

(60) Continuation of application No. 13/089,163, filed on Apr. 18, 2011, now Pat. No. 8,673,455, which is a division of application No. 11/671,697, filed on Feb. 6, 2007, now Pat. No. 7,939,142.

(51) Int. Cl.
*B22F 7/00* (2006.01)
*C23C 28/02* (2006.01)
(Continued)

(52) U.S. Cl.
CPC ..... *C23C 28/026* (2013.01); *C23C 24/08* (2013.01); *C23C 24/10* (2013.01); *C23C 28/027* (2013.01);
(Continued)

(58) Field of Classification Search
None
See application file for complete search history.

(56) References Cited

U.S. PATENT DOCUMENTS

| | | | |
|---|---|---|---|
| 2,833,638 | A | 5/1958 | Owen |
| 3,800,891 | A | 4/1974 | White et al. |

(Continued)

FOREIGN PATENT DOCUMENTS

| | | |
|---|---|---|
| EP | 0556808 | 9/1996 |
| WO | 02058927 | 8/2002 |
| WO | 2006034054 | 3/2006 |

OTHER PUBLICATIONS

Farmer et al., "Corrosion characterization of iron-based high-performance amorphous-metal thermal spray coatings", Proceedings of AMME PVP: Pressure Vessels & Piping Division Conference (Jul. 17-21, 2005): 1-7.

(Continued)

*Primary Examiner* — Humera Sheikh
*Assistant Examiner* — Seth Dumbris
(74) *Attorney, Agent, or Firm* — Fox Rothschild LLP

(57) ABSTRACT

A coating steel component with a pattern of an iron based matrix with crystalline particles metallurgically bound to the surface of a steel substrate for use as disc cutters or other components with one or more abrading surfaces that can experience significant abrasive wear, high point loads, and large shear stresses during use. The coated component contains a pattern of features in the shape of freckles or stripes that are laser formed and fused to the steel substrate. The features can display an inner core that is harder than the steel substrate but generally softer than the matrix surrounding the core, providing toughness and wear resistance to the features. The features result from processing an amorphous alloy where the resulting matrix can be amorphous, partially devitrified or fully devitrified.

7 Claims, 5 Drawing Sheets

(51) Int. Cl.
*C23C 24/08* (2006.01)
*C23C 24/10* (2006.01)

(52) U.S. Cl.
CPC .. *Y10T 428/12007* (2015.01); *Y10T 428/12049* (2015.01); *Y10T 428/1259* (2015.01); *Y10T 428/12347* (2015.01); *Y10T 428/12396* (2015.01); *Y10T 428/12458* (2015.01); *Y10T 428/12486* (2015.01); *Y10T 428/12576* (2015.01)

(56) References Cited

U.S. PATENT DOCUMENTS

| | | | | |
|---|---|---|---|---|
| 4,237,184 | A | 12/1980 | Gonseth et al. | |
| 4,762,677 | A | 8/1988 | Dolgin | |
| 5,554,415 | A | 9/1996 | Turchan et al. | |
| 5,635,243 | A | 6/1997 | Turchan et al. | |
| 5,643,641 | A | 7/1997 | Turchan et al. | |
| 5,648,127 | A | 7/1997 | Turchan et al. | |
| 5,648,174 | A | 7/1997 | Yamagata et al. | |
| 5,731,046 | A | 3/1998 | Mistry et al. | |
| 5,852,272 | A * | 12/1998 | Amano | 219/76.14 |
| 6,274,206 | B1 | 8/2001 | Turchan et al. | |
| 6,689,234 | B2 | 2/2004 | Branagan | |
| 6,767,419 | B1 * | 7/2004 | Branagan | 148/522 |
| 7,345,255 | B2 | 3/2008 | Jiang et al. | |
| 2002/0028422 | A1 | 3/2002 | Kumar | |
| 2003/0051781 | A1 * | 3/2003 | Branagan | 148/561 |
| 2004/0086674 | A1 | 5/2004 | Holman | |
| 2004/0250929 | A1 | 12/2004 | Branagan | |
| 2006/0163217 | A1 | 7/2006 | Jiang et al. | |
| 2007/0029295 | A1 * | 2/2007 | Branagan et al. | 219/146.1 |
| 2007/0107809 | A1 * | 5/2007 | Farmer et al. | 148/403 |
| 2009/0025834 | A1 * | 1/2009 | Poon et al. | 148/403 |
| 2010/0084052 | A1 * | 4/2010 | Farmer et al. | 148/403 |

OTHER PUBLICATIONS

World Tunnelling, "The cutting edge", WT Materials Review (2009): 86-89.

* cited by examiner

*a)* *b)*

*a)* *b)*

*a)* *b)* *c)*

IN-SITU COMPOSITE FORMATION OF DAMAGE TOLERANT COATINGS UTILIZING LASER

CROSS REFERENCE TO RELATED APPLICATIONS

This application is a continuation of U.S. application Ser. No. 13/089,163, filed Apr. 18, 2011, entitled "IN-SITU COMPOSITE FORMATION OF DAMAGE TOLERANT COATINGS UTILIZING LASER," which was a Divisional of U.S. application Ser. No. 11/671,697, filed Feb. 6, 2007, (now U.S. Pat. No. 7,939,142, issued May 10, 2011), entitled "IN-SITU COMPOSITE FORMATION OF DAMAGE TOLERANT COATINGS UTILIZING LASER," the disclosures of which are fully incorporated herein by reference.

STATEMENT REGARDING FEDERALLY SPONSORED RESEARCH OR DEVELOPMENT

The United States Government has rights in this invention pursuant to contract no. DE-AC05-00OR22725 between the United States Department of Energy and UT-Battelle, LLC.

FIELD OF THE INVENTION

The invention relates to patterned hard iron based amorphous, partially devitrified, or fully devitrified metal coatings for abrasive surfaces on steel substrates for cutting tools such as disc cutters and a method of preparing the metal coating.

BACKGROUND OF THE INVENTION

Disc Cutters are used in the mining industry to cut through rock and create tunnels and other cavities. Multiple disc cutters are located at various positions on the face of a tunnel boring machine (TBM) where the placement of the cutters balance thrust force across the face of the TBM to maximize penetration. The cutter head rotates at 4 to 10 rpm and breaks rock into large chips, which fall into buckets rotating with the head where the buckets lift the chips to a conveyer belt to discharge the rock chips for final transport out of a tunnel. The typical TBM cuts 30 to 40 meters of tunnel per day.

A typical state of the art disc cutter is a single disc cutter that has a disc diameter of 17 to 19 inches. The edge of the cutter, where contact with the rock is made, is a tool steel ring. A good ring requires hardness but also must be tough and have a high impact resistance for long wear. The industrial standard ring is H13 tool steel. Some proprietary alloys are available for steel rings for blade cutters; including alloys where particles of tungsten carbide are included in the matrix of the steel. A significant portion of the time to bore a tunnel, approximately 40%, is down time with the majority of the down time is required for the replacement of disc cutters on the face of the TBM. To this end an improvement of the wear resistance of the disc cutter can increase the energy efficiency of the boring process by as much as 25%.

State of the art disc cutter rings are uncoated metals. When coatings have been applied to cutting surfaces for disc cutter, they have been applied as a continuous coating. These continuous coatings have failed due to their propensity for spallation when subjected to substantial alternating cycles of tensile and compressive strain, like that of a disc cutter during boring into rock. There remains a need for an abrasive surface with superior hardness and wear resistance for use on disc cutters or other devices that experience significant abrasive wear, high point loads, and large shear stresses during use.

Such devices include bits in road headers, cutting tools, augers, earth moving equipment, blades, teeth, print and dye machines, paving equipment and road removal equipment.

SUMMARY OF THE INVENTION

A coated steel component where a steel alloy substrate has a discontinuous pattern of features where an iron based matrix containing crystalline particles where the matrix is metallurgically bound to a surface of the substrate. The matrix can be amorphous, partially devitrified or fully devitrified. The complex coating can have an inner core of lower hardness than the outer surface of the complex coating. The crystalline particles can be metal carbides, metal borides, metal carboborides, metal oxides or mixtures of these particles where the one or more metals can be selected from tungsten, chromium, and molybdenum. The pattern of the features can be stripes, freckles or any combination of stripes and freckles. The thickness of the features can be from 100 μm to 700 μm.

A method to form a patterned coated steel component involves the steps of: providing a steel substrate; depositing a powder of an amorphous alloy onto a surface of the steel substrate; applying focused energy via a laser beam on a portion of the surface to liquefy the powder and the contacting surface portion of the steel substrate; removing or reducing the focused energy from the laser beam from the portion of the surface to solidify the portion of the surface and form a pattern feature; repeating the steps of applying and removing until all pattern features are formed, after which any of the powder that had not been liquefied and solidified to yield the patterned coated steel component can be extricated. The steel substrate can be tool steel. The amorphous alloy can be SAM-2X5 ($Fe_{50}Mn_2Cr_{18}Mo_7W_2B_{15}C_4Si_2$ at. %), SAM-1651 ($Fe_{48}Mo_{14}Cr_{15}Y_2C_{15}B_6$, at. %), or SAM-10+1 at. % ($Fe_{57}Cr_{21}Mo_2W_2B_{17}C_1$, at. %). The laser beam can be a Nd YAG laser beam. The pattern features can be stripes or freckles. The steps of applying and removing can be carried out in the presence of a flowing inert gas. The inert gas can be a argon or other inert gases such as nitrogen or helium. The powder can include a polymeric binder. The powder can be deposited with a thickness of 200 to 700 μm. The method can have the combined steps of depositing, applying, and removing repeated until the features have a desired thickness resulting from the combination of multiple layers.

A disc cutter can have a steel alloy substrate and a discontinuous pattern of surface features that are an iron containing matrix with crystalline particles where the features are metallurgically bonded to a surface of the substrate. The matrix can be amorphous, partially devitrified or fully devitrified. The complex coating can have an inner core of lower hardness than the outer surface of the complex coating. The crystalline particles can be individually or in combination metal carbides, metal borides, metal carboborides or metal oxides where the one or more metals can be tungsten, chromium, or molybdenum. The pattern of said features can be stripes, freckles or any combination of stripes and freckles. The thickness of the features can be from 100 μm to 700 μm.

DETAILED DESCRIPTION OF THE INVENTION

The invention provides a wear resistant patterned coating fused to the surface of a disc cutter or other component requiring an abrasive wear resistant surface that is resistant to spallation. The coating can be present as a pattern of stripes and/or freckles that comprise an iron based matrix containing crystalline particles fused via a metallurgical bond to the surface of a steel disc cutter. The fusing results in a feature that can be amorphous, partially devitrified, or fully devitrified depending upon the composition of the iron matrix, crystalline particles, and the rate at which the liquefied amorphous alloy precursor solidifies. The invention preferably has features that are partially or fully devitrified where a large amount of hard crystalline particles is formed from the amorphous alloy precursor. The crystalline particles can be metal carbides, metal borides, metal carboborides or metal oxides. The features can display a microstructure of layered phases with alternating high-low hardness values for each subsequent layer or phase based on the diffusion and precipitation of metal carbide, metal boride, metal carboboride or metal oxide particles. The thickness of the features can be from 100 μm to 700 μm. By carrying out the patterning process a single layer at a time, in combination with repeating the process to form features with multiple layers of the complex coating, the final thickness can be as great as a few millimeters.

Figure 1:
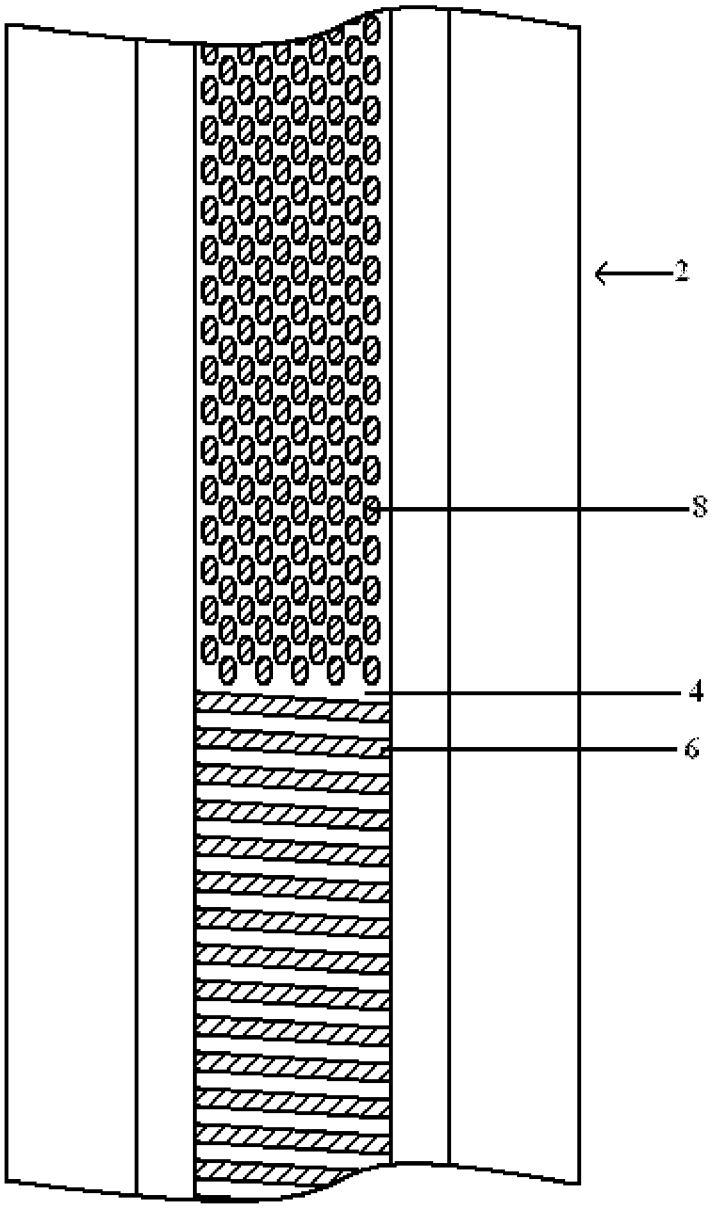
FIG. 1 shows the cutting edge of a disc cutter having the patterned coating of the invention with the embodiment of freckles and the embodiment of stripes.

FIG. 1 illustrates a portion of a disc cutter ring 2 with an edge 4 with a portion having a pattern of freckles 8 and a portion showing a pattern of stripes 6. The complex coating can be formed by aspirating an amorphous alloy powder onto the steel surface and laser fusing a portion of the powdered surface into a glassy/nanocrystaline/microcrystalline complex form. The process of fusing also forms a metallurgical interface to the steel substrate by which the feature is bound or bonded to the steel substrate, as a portion of the substrate surface contacting the powder is also liquefied or partially liquefied along with the powder. By the use of an appropriate amorphous alloy powder and laser process, a desired pattern, microstructure, and complex layered system can be achieved and optimized to yield a patterned coated steel component that displays superior mechanical properties.

Amorphous alloy powders can be produced via gas atomization in bulk quantities. Among the powders commercially available in large quantities for use in the invention are SAM–2X5 ($Fe_{50}Mn_2Cr_{18}Mo_7W_2B_{15}C_4Si_2$ at. %), SAM-1651 ($Fe_{48}Mo_{14}Cr_{15}Y_2C_{15}B_6$, at. %), and SAM-10+1 at. % C ($Fe_{57}Cr_{21}Mo_2W_2B_{17}C_1$, at. %). Upon focusing of a laser beam, for example from an Nd YAG laser, onto the steel surface to which an amorphous powder has been deposited via aspiration or other suitable means, the powder and some substrate melt. Upon removal of the laser beam, the liquid alloy rapidly cools to form the amorphous, partially devitrified, or fully devitrified alloy feature. The steel of the disc cutter acts as a heat sink to remove heat rapidly from the substrate side of the feature. The top surface can be cooled by an impinging inert gas. The rapid cooling permits the tungsten, boron, chromium, molybdenum and carbon to precipitate as complex metal carbides, metal borides, or metal carboborides in an amorphous, partially devitrified or fully devitrified ferrite matrix that is metallurgically bonded to the tool steel substrate. By using a slow cooling rate the metal carbides and borides can precipitate in a devitrified ferrite yielding a microcrystalline matrix. The coatings can be from 1.3 to more than 7 times the hardness of the tool steel substrate, as measured as a Vicker's hardness, depending on the tool steel selected as the substrate, the amorphous powder used, and the conditions of the process.

The SAM powders can be deposited via aspiration or other means onto the steel substrate generally with an included polymer based binder. The ratio of amorphous powder to binder can be about 5 to about 10. The binder retains the powder in place on the steel substrate until laser fusing is carried out at which time the excess binder and amorphous powder can be extricated by a variety of means including brushing with a wire brush. The powder-binder coating precursor thickness can be about 200 to about 600 μm in thickness.

The laser can be an Nd YAG laser with a power level of 1 to 4.5 kW or a 2 kW fiber laser. The laser can be focused on the outside of the ring of a disc cutter to produce a pattern on the outside edge of the ring. The ring can be rotated via a turntable and the laser secured to a frame situated such that the beam can be focused on the edge of the ring. Alternately, the ring can be mounted to a frame and the laser moved around the edge of the frame. The patterning generation with the laser can be carried out manually, with a semi-automated system or with a fully automated system. The patterning can be formed with the aid of a computer aided design compatible system.

Figure 2:
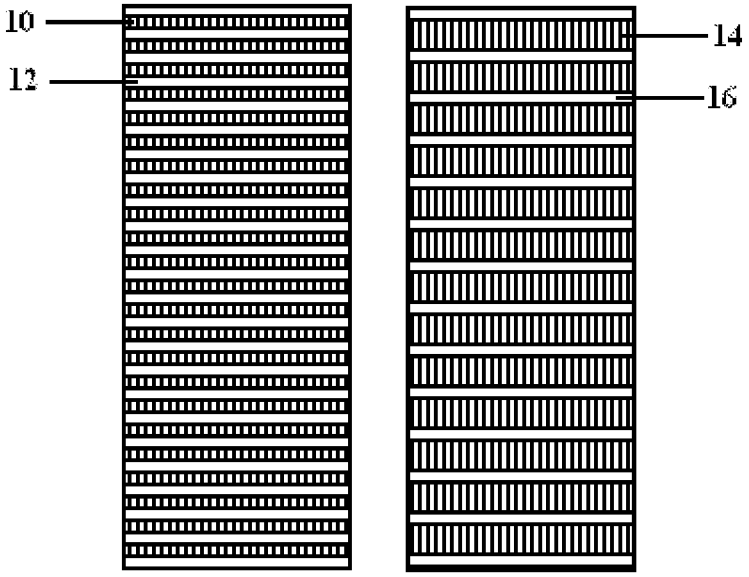
FIG. 2 shows alternative patterns of a) stripes with equal width stripes and stripe offsets and b) wide stripes with smaller stripe offsets.

A pattern of stripes can be formed using a constant power level of the laser with fusing occurring perpendicular to the ring rotating on a turntable as the laser beam is moved across the edge of the ring. A series of stripes and offsets between the stripes that can vary in absolute and relative proportions are formed along the edge of the ring. For example, as shown in FIG. 2*a*), a series of 2 mm stripes 10 can be offset 12 by 2 mm or, as shown in FIG. 2B), a series of 5 mm stripes 14 can be offset 16 by 2 mm. Although an irregular pattern, with varying widths of stripes and offsets along the edge of the ring, can be formed, in general a regular pattern will require the least manipulation of the rotation of the ring and the movement of the laser and will result in a balanced patterned ring.

Figure 3:
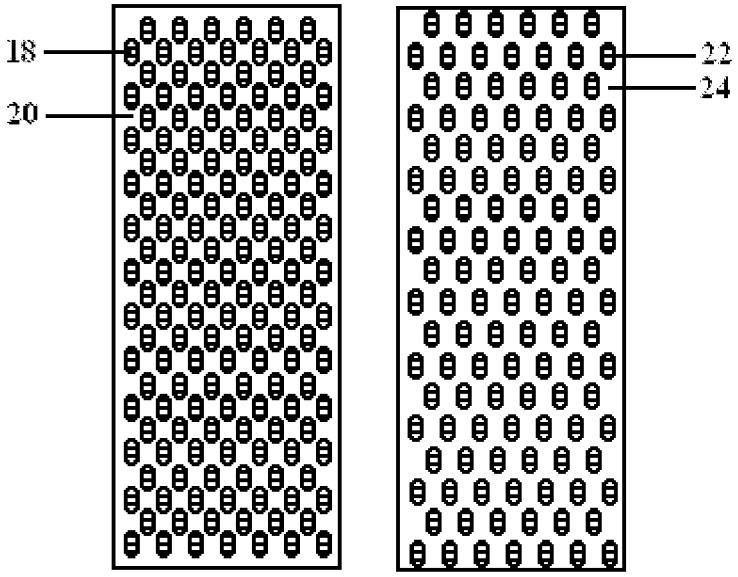
FIG. 3 shows alternative patterns of a) freckles with short spacing between freckles and b) freckles with long spacing between freckles.

The patterning of freckles can be carried out by varying the power level of the laser with the fusion occurring parallel to the rotation of the disc by a turntable. The power of the laser can be varied from a high level to a low level such that fusion of the alloy to the steel substrate occurs while the power is high and essentially no fusion occurs during a period when the power is low. In this manner the width of elliptical freckles is dependent upon the diameter of the laser beam and the length of the freckle depends upon the profile of periods with high power to periods of low power relative to the rate of rotation of the ring. Using the same laser power and laser power profile, a series of freckles with similar width can display a greater offset by increasing the rate of rotation of the disc. For example, as illustrated in FIG. 3, rows of freckles that differ primarily in spacing, for example one with the center of freckles 18 offset 20 by 6 mm, FIG. 3*a*), and another with freckles 22 offset 24 by 8 mm, FIG. 3*b*), can be formed by using a constant laser power and profile but increasing the rate of rotation of the ring by 33% to achieve the pattern with the greater spacing of freckles in a row. Upon one or more rotations of the ring for a fixed laser position to generate a row of freckles, the focus of the laser can be offset on the surface of the ring and a second row of freckles can be formed. Subsequently additional rows of freckles can be fused on the ring. The adjacent rows of freckles can be patterned in phase such that a row of freckles occurs perpendicular to the ring; can be 180 degrees out of phase where nearest neighbor freckles in adjacent rows lie midway between nearest neighbors in a given row, as shown in FIG. 3; or the phase can be varied to give a more random pattern. In general, a series of rows in a regular pattern permits a more balanced ring.

Figure 4:
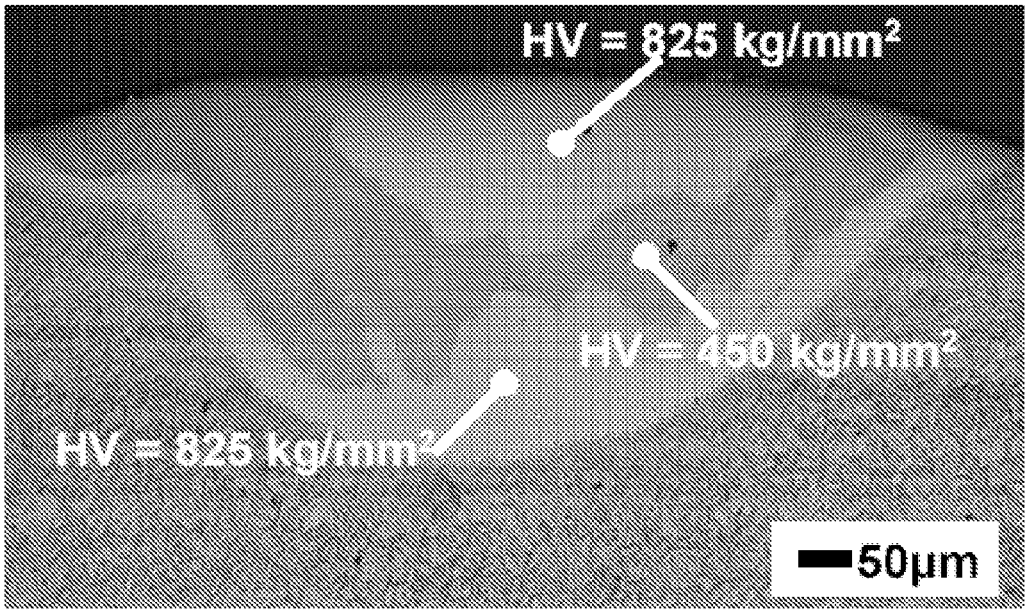
FIG. 4 shows a scanned optical microscopy profile of a SAM-2X5 freckle on a H13 tool steel substrate with Vicker's Hardness values for various portions of the freckle.

The striped and freckled features from the cooled amorphous or complex alloy display an inner core that is generally softer than the amorphous or complex alloy at the surface or the amorphous or complex alloy at the interface with the substrate. Although the inner core of the coating feature is generally softer than the portions around the core, the core is generally significantly harder than the typical tool steel substrate. This is shown in FIG. 4 where a scanned optical profile of a SAM-2X5 on a H13 tool steel substrate includes Vicker's Hardness values, HV, for the alloy at the surface, inner core and substrate interface portions of the freckle. The inner core alloy hardness of 450 kg/mm$^2$ is significantly less than that of the alloy portions around it of 825 kg/mm$^2$. Vicker's Hardness Values up to about 1,350 kg/mm$^2$ can be prepared with both the SAM-2X5 and SAM-1651 coatings by the laser process. These non-core alloy values are near that observed for a bulk devitrified hardnesses. The lower core amorphous alloy value of 450 kg/mm$^2$ is greater than that of the value of 250 to 350 kg/mm$^2$ for H13 tool steel. This feature of a relatively soft inner core surrounded by harder alloy imparts increased toughness to the material. This feature of harder alloy outer surfaces and a relatively softer alloy core depend upon the composition of the amorphous alloy powder employed, and is a feature that has not been observed for alloys that are used in common hardface technologies.

The metallurgical bonding of the amorphous alloy to the steel provides a well adhered coating that displays a significant resistance to cracking and spalling. Discs were prepared using SAM-2X5 on a tool steel disc cutter ring and tested using the linear cutting machine at the Colorado School of Mines to simulate breaking of barre granite by the coated disc cutter. Barre granite is one of the hardest rocks available. The discs were subjected to average loads of 50 to 75 kips and point loads of up to 300 kips for over one hundred passes at average cut depths of 0.1 to 0.2 inches. No evidence of mechanical cracking or spalling of the coating was observed. These fused amorphous alloy derived coatings were the first coatings to survive testing on the machine in its 25 year history.

Figure 5:
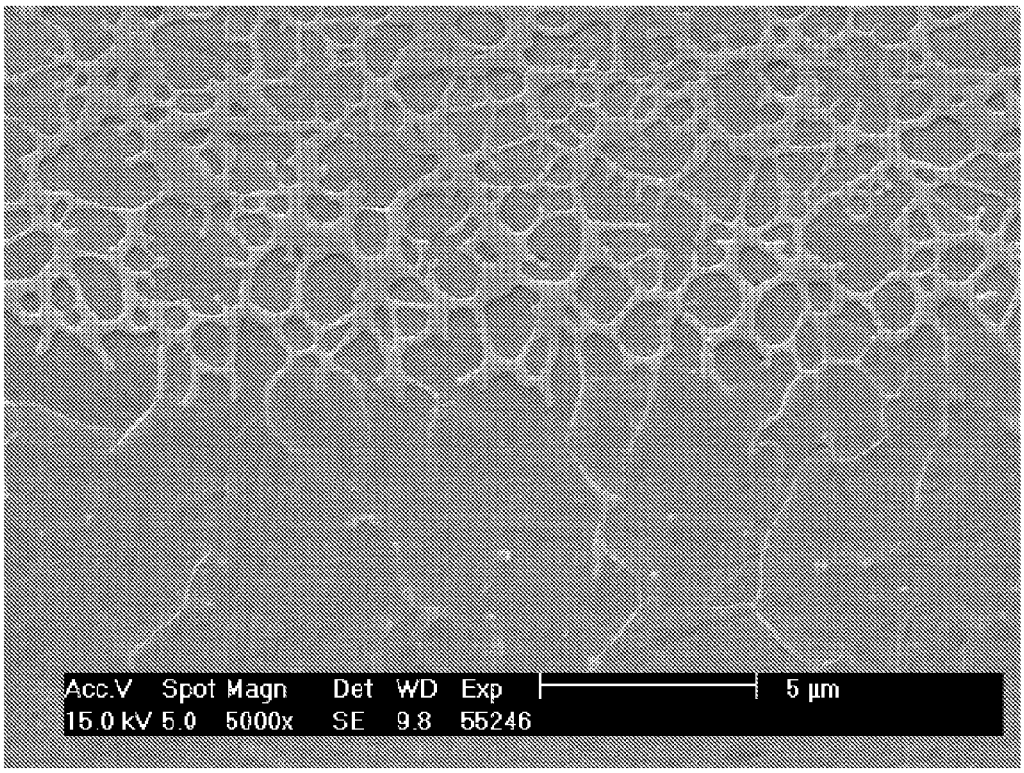
FIG. 5 shows a scanned scanning electron microscopy image of the metallurgical interface between a SAM-2X5 coating and a H13 tool steel substrate.

FIG. 5 shows a scanned scanning electron microscopy (SEM) image for the metallurgical interface between a SAM-2X5 coating and a H13 tool steel substrate. The high degree of intermixing and high surface area between the alloy and the substrate is believed to be responsible for the observed lack of debonding and spalling during the cutting machine tests.

Figure 6:
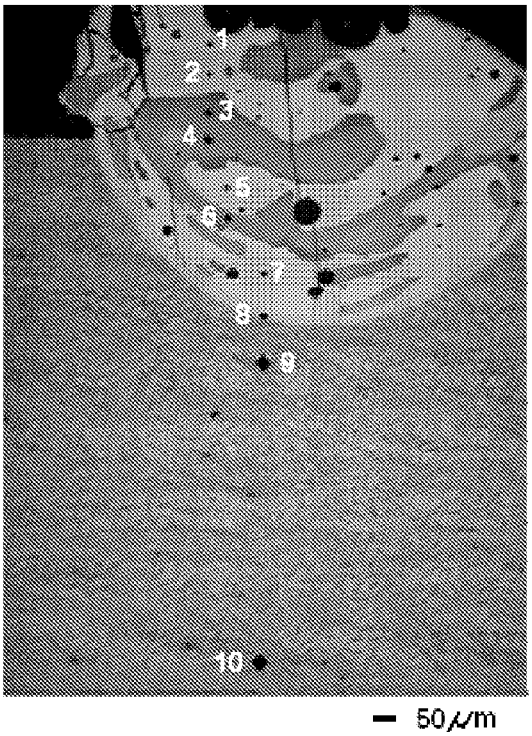
FIG. 6 shows a scanned optical microscopy profile for an SAM-1651 freckle on a H13 tool steel substrate showing the position for Vicker's Hardness test indents for the hardness values given in Table 1.

The absolute values of hardness for the coating depend upon the amorphous alloy powder used. By using SAM-1651, illustrated in the scanned image shown in FIG. 6, rather than SAM-2X5, illustrated in FIG. 4, a greater hardness of the freckles can be achieved. FIG. 6 is for SAM-1651 on H13 tool steel prepared using a laser power level of 2.5 kW, a ring rotating at 1,500 mm/min, an inert gas flow parallel to the patterned surface at a flow rate of 0.25 c.f.m., and a coating precursor thickness that ranged from 200 to 220 μm. At the various positions, 1 through 10 indicated on FIG. 6, the Vicker's Hardness values vary from 1348 to 609 within the freckle; where the alloy within the core displays hardness values lower than those of the alloy at the surface and substrate interface. Again the hardness value of the alloy at the inner core is greater than that of the H13 tool steel substrate.

TABLE 1

Vicker's Hardness for Various Positions of Freckle on a H13 Tool Steel Substrate Indicated in FIG. 6.

| Indent No. | HV |
|---|---|
| 1 | 1,347.5 |
| 2 | 1,272.1 |
| 3 | 767.0 |
| 4 | 609.1 |
| 5 | 1,275.1 |
| 6 | 765.9 |
| 7 | 1,258.0 |
| 8 | 781.5 |
| 9 | 240.8 |
| 10 | 226.8 |

Figure 7:
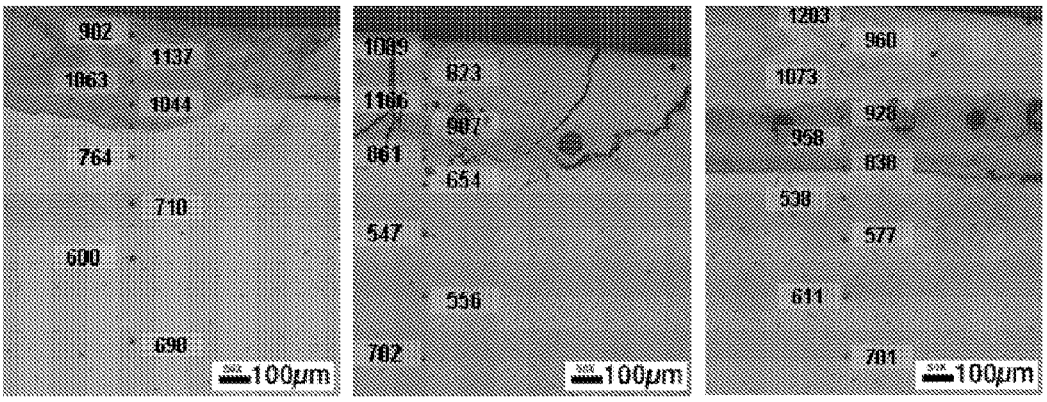
FIG. 7 shows scanned optical microscopy profiles with HV values for various depths of testing for SAM-2X5 coated on a an annealed H13 tool steel substrate for stripes formed from a) one, b) two, and c) three layers of amorphous metal coating.

The coating can be built up in layers. One layer of coating can be patterned upon a coating layer that has already been patterned. This is shown in FIG. 7 where a scanned image of specially annealed H13 substrate is coated by: a) one, b) two, and c) three coating layers as stripes. In this manner the coating layer can be increased in thickness while maintaining the ability to solidify the coating rapidly to obtain the hardness inherent to the amorphous alloy. The stripes were fused at a laser power of 1.25 kW, the ring rotating at 1500 mm/min, an inert gas flow parallel to the patterned surface at a flow rate of 0.25 c.f.m., and a coating precursor thickness for each layer of coating of about 200 μm. Little loss of hardness is observed for layers onto which a subsequent layer has been placed. The specially annealed H13 tool steel displays a hardness of about 650 kg/mm$^2$ while the top alloy displays hardness values of about 840 to about 1200 kg/mm$^2$ where the surface layer displays higher values than lower layers.

It is to be understood that while the invention has been described in conjunction with the preferred specific embodiments thereof, that the foregoing description as well as the examples, which followed are intended to illustrate and not limit the scope of the invention. Other aspects, advantages and modifications within the scope of the invention will be apparent to those skilled in the art to which the invention pertains.

We claim:

1. A coated steel component comprising:

a steel substrate; and a discontinuous pattern of surface features, each surface feature comprising a plurality of layers, wherein each layer comprises an iron comprising matrix containing crystalline particles, wherein each of the plurality of layers has a thickness of from 100 to 700 μm, and wherein said features are metallurgically bound to a surface of said substrate, wherein each of said surface features comprises an inner core of lower hardness than the outer surface of the feature, and wherein the inner core has a hardness of 226.8 to 450 $kg/mm^2$ and the outer surface of the feature has a hardness of from 825 to 1,350 $kg/mm^2$.

2. The coated steel component of claim 1, wherein said matrix is partially devitrified or fully devitrified.

3. The coated steel component of claim 1, wherein said matrix is amorphous.

4. The coated steel component of claim 1, wherein said crystalline particles comprise individually or in combination metal carbides, metal borides, metal carboborides or metal oxides.

5. The coated steel component of claim 4, wherein said metal comprises one or more selected from the group consisting of tungsten, chromium, and molybdenum.

6. The coated steel component of claim 1, wherein said pattern comprises stripes, freckles or any combination of stripes and freckles.

7. A coated steel component comprising a steel substrate; and a discontinuous pattern of surface features, wherein the discontinuous pattern of surface features comprises an amorphous ferrite matrix comprising precipitated crystalline particles selected from the group consisting of metal carboborides, metal oxides, and combinations thereof, wherein the ferrite matrix is at least partially devitrified, and where said surface features are metallurgically bound to a surface of said substrate, and wherein each of said surface features comprises an inner core of lower hardness than the outer surface of the feature, and wherein the inner core has a hardness of 226.8 to 450 $kg/mm^2$ and the outer surface of the feature has a hardness of from 825 to 1,350 $kg/mm^2$.

* * * * *